US012569111B2

(12) United States Patent
Kelsch

(10) Patent No.: US 12,569,111 B2
(45) Date of Patent: Mar. 10, 2026

(54) FOOTWEAR VACUUM ASSEMBLY

(71) Applicant: Walker Kelsch, Riverton, UT (US)

(72) Inventor: Walker Kelsch, Riverton, UT (US)

( * ) Notice: Subject to any disclaimer, the term of this patent is extended or adjusted under 35 U.S.C. 154(b) by 425 days.

(21) Appl. No.: 18/123,287

(22) Filed: Mar. 19, 2023

(65) Prior Publication Data

US 2024/0306882 A1 Sep. 19, 2024

(51) Int. Cl.
*A47L 23/26* (2006.01)

(52) U.S. Cl.
CPC ..... *A47L 23/263* (2013.01)

(58) Field of Classification Search
CPC ..... A47L 23/22; A47L 23/26; A47L 23/263
USPC ..... 15/215, 30, 216
See application file for complete search history.

(56) References Cited

U.S. PATENT DOCUMENTS

| | | | |
|---|---|---|---|
| 6,067,688 | A | 5/2000 | West |
| 6,532,618 | B2 | 3/2003 | Koch |
| 7,472,452 | B2 | 1/2009 | Junell |
| 8,839,812 | B2 | 9/2014 | Tanhehco |
| 9,049,978 | B1 | 6/2015 | Shamberger |
| D735,494 | S | 8/2015 | Wendling |
| 9,986,889 | B2 | 6/2018 | Looney |
| 10,827,898 | B2 | 11/2020 | Moran |

FOREIGN PATENT DOCUMENTS

| | | | | |
|---|---|---|---|---|
| CN | 112137561 A | * | 12/2020 | ..... A47L 23/02 |
| KR | 100473506 B1 | * | 3/2005 | |
| KR | 100821510 B1 | * | 4/2008 | |
| WO | WO2007140218 | | 12/2007 | |

OTHER PUBLICATIONS

Translation of KR100473506B1 (Year: 2005).*
Translation of CN112137561A (Year: 2020).*
Translation of KR100821510B1 (Year: 2008).*

* cited by examiner

*Primary Examiner* — Tom Rodgers

(57) ABSTRACT

A footwear vacuum assembly includes a mat that is positionable on a floor such that the mat can be stepped upon by a user. The mat has a plurality of suction holes integrated into the mat and the plurality of suction holes can be stepped upon by the user. A suction conduit is integrated into the mat and the suction conduit is in communication with the plurality of suction holes. A nozzle is attached to the mat and the nozzle can be fluidly coupled to a suction hose of a vacuum source. The nozzle is in communication with the suction conduit to suck the debris from soles of the user's shoes into the vacuum source when the user steps on the plurality of suction holes.

5 Claims, 4 Drawing Sheets

FOOTWEAR VACUUM ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to vacuum devices and more particularly pertains to a new vacuum device for suctionally removing debris from soles of shoes. The device includes a mat that is positioned on a floor which has a plurality of suction holes upon which a user can stand. The device includes a suction conduit integrated into the mat which is in fluid communication with the plurality of suction holes. The device includes a nozzle attached to the mat which is fluidly coupled to the suction conduit. The nozzle is attachable to a suction hose of a vacuum source.

(2) Description of Related Art Including Information Disclosed Under 37 CFR 1.97 and 1.98

The prior art relates to vacuum devices including a shoe cleaning device that is embedded into a floor of a building which includes rotating brushes. The prior art discloses a floor mat that includes a plurality of bristles and which is attached to a vacuum. The prior art discloses a shoe cleaning device that includes a foraminous tray which is fluidly coupled to a vacuum source. The prior art discloses a surgical suction mat that has a plurality of grooves for collecting surgical fluids which is fluidly coupled to a vacuum source. The prior art discloses a shoe cleaning mat that includes a plurality of horizontally rotating brushes and a plurality of vertically rotating brushes.

BRIEF SUMMARY OF THE INVENTION

An embodiment of the disclosure meets the needs presented above by generally comprising a mat that is positionable on a floor such that the mat can be stepped upon by a user. The mat has a plurality of suction holes integrated into the mat and the plurality of suction holes can be stepped upon by the user. A suction conduit is integrated into the mat and the suction conduit is in communication with the plurality of suction holes. A nozzle is attached to the mat and the nozzle can be fluidly coupled to a suction hose of a vacuum source. The nozzle is in communication with the suction conduit to suck the debris from soles of the user's shoes into the vacuum source when the user steps on the plurality of suction holes.

An alternative embodiment of the disclosure meets the needs presented above by generally comprising a vacuum that has a suction hose and a mat that is positionable on a floor such that the mat can be stepped upon by a user. The mat has a plurality of suction holes integrated into the mat and the plurality of suction holes can be stepped upon by the user. A suction conduit is integrated into the mat and the suction conduit is in communication with the plurality of suction holes. A nozzle is attached to the mat and the nozzle can be fluidly coupled to the suction hose of the vacuum. The nozzle is in communication with the suction conduit to suck the debris from soles of the user's shoes into the vacuum when the user steps on the plurality of suction holes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
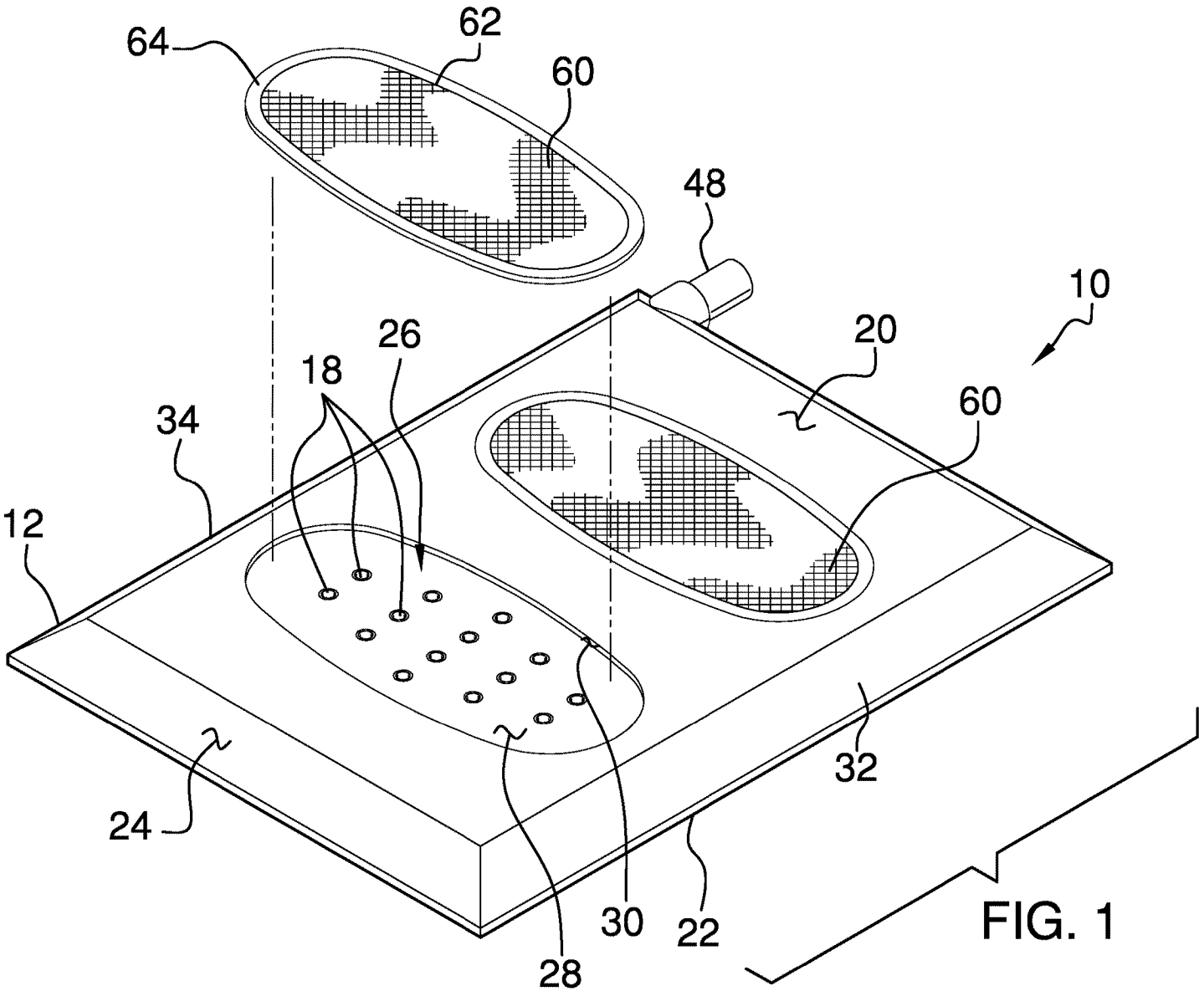
FIG. 1 is an exploded perspective view of a footwear vacuum assembly according to an embodiment of the disclosure.
Figure 2:
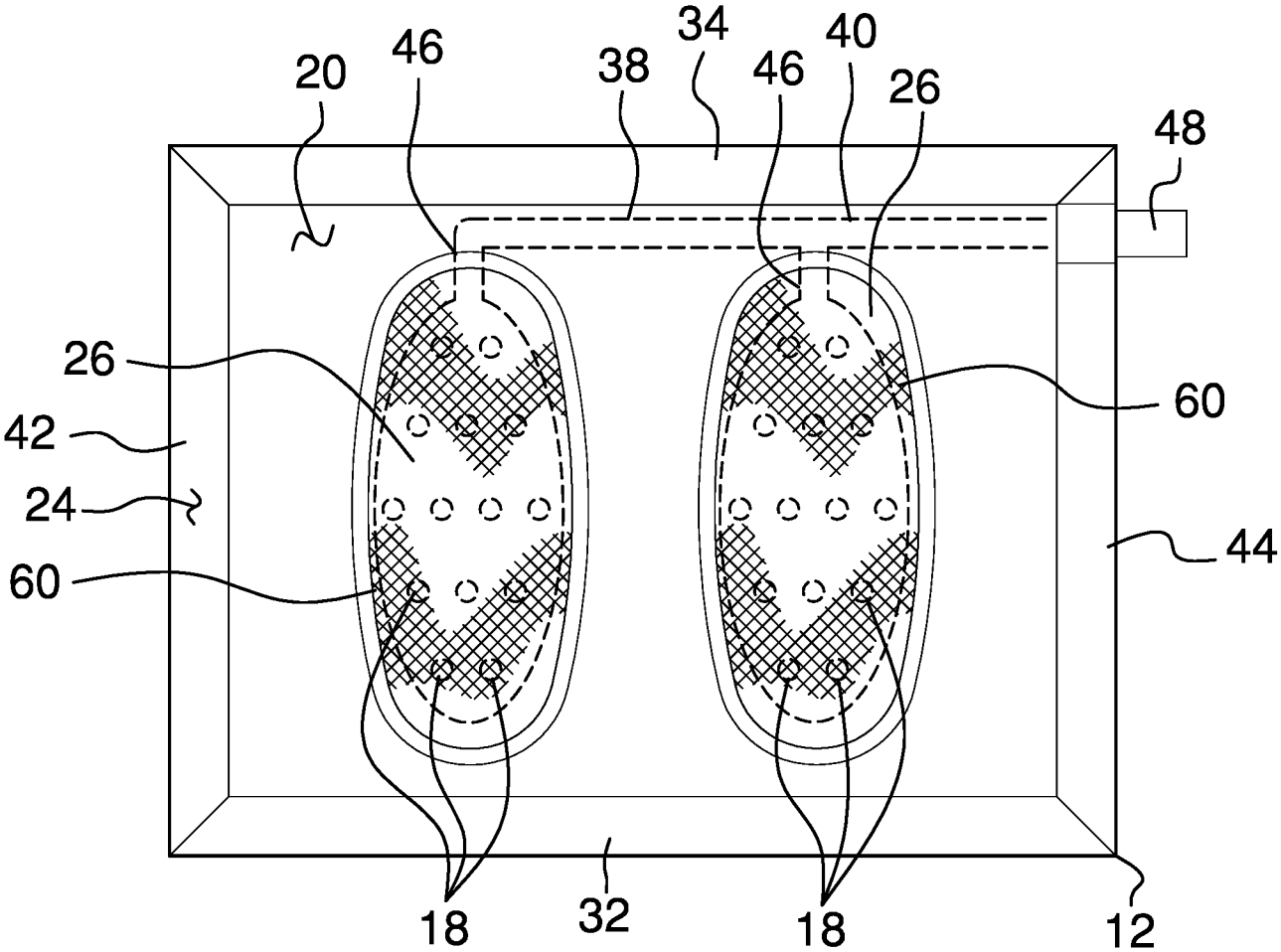
FIG. 2 is a top phantom view of an embodiment of the disclosure.
Figure 3:
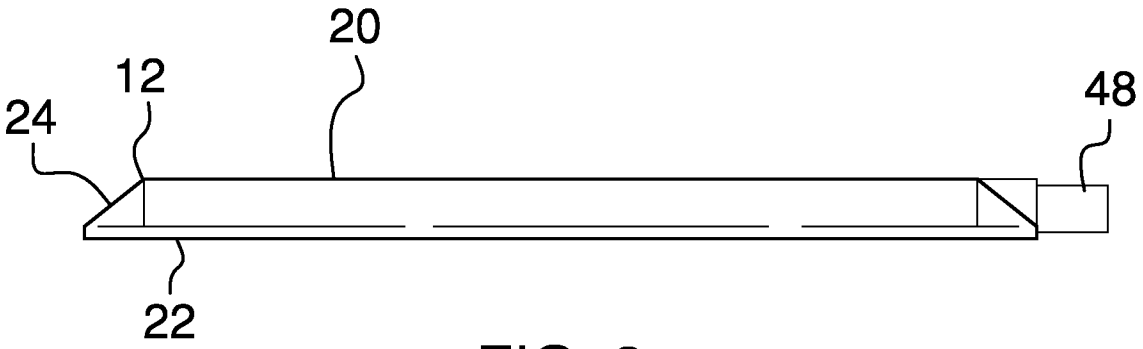
FIG. 3 is a front view of an embodiment of the disclosure.
Figure 4:
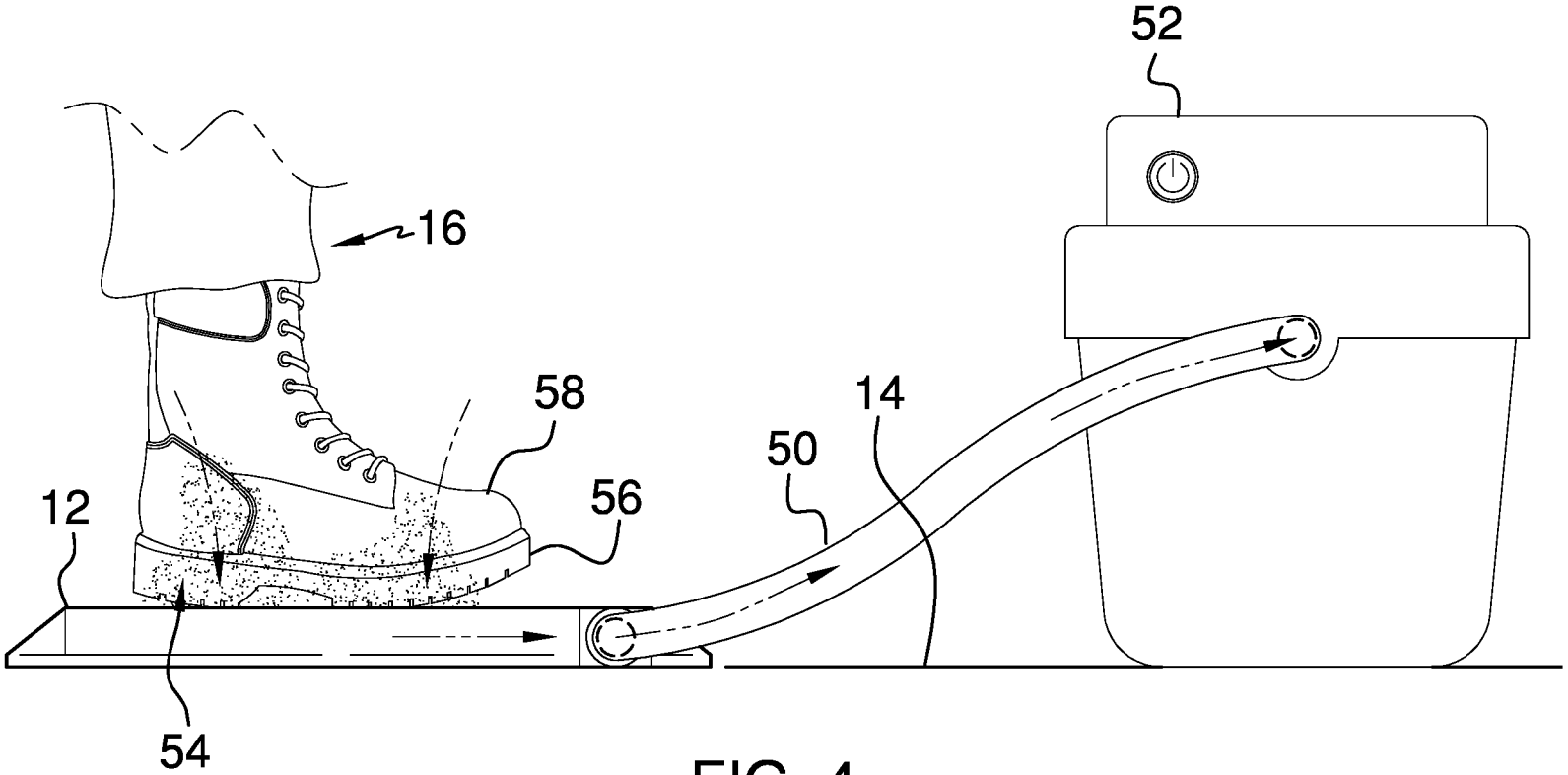
FIG. 4 is a perspective in-use view of an embodiment of the disclosure.

With reference now to the drawings, and in particular to FIGS. 1 through 4 thereof, a new vacuum device embodying the principles and concepts of an embodiment of the disclosure and generally designated by the reference numeral 10 will be described.

As best illustrated in FIGS. 1 through 4, the footwear vacuum assembly 10 generally comprises a mat 12 that is positionable on a floor 14 such that the mat 12 can be stepped upon by a user 16. The mat 12 may be located near an entry of a house, for example, such that the user 16 can step upon the mat 12 when the user 16 comes inside from being outdoors. The mat 12 has a plurality of suction holes 18 integrated into the mat 12 and the plurality of suction holes 18 is strategically positioned on the mat 12 such that the plurality of suction holes 18 can be stepped upon by the user 16. The mat 12 has a top surface 20, a bottom surface 22 and a perimeter surface 24 extending between the top surface 20 and the bottom surface 22. Additionally, the perimeter surface 24 angles inwardly between the bottom surface 22 and the top surface 20 such that the mat 12 has a trapezoidal shape. The mat 12 may have a length ranging between approximately 55.0 cm and 70.0 cm, a width ranging between approximately 40.0 cm and 50.0 cm and a height ranging between approximately 2.5 cm and 5.0 cm.

The mat 12 has a pair of wells 26 each extending downwardly in the top surface 20 and each of the wells 26 has a lower bounding surface 28 and a lateral bounding surface 30. The lateral bounding surface 30 of each of the wells 26 is continuously arcuate such that each of the wells 26 is rounded. Each of the wells 26 is elongated along an axis extending between a front side 32 and a back side 34 of the perimeter surface 24 of the mat 12 such that each of the wells 26 has an ovoid shape. Each of the plurality of suction holes 18 extends through the lower bounding surface 28 of a respective one of the wells 26 and the plurality of suction holes 18 in each of the wells 26 is arranged into a plurality of rows 36 in the respective well 26. Each of the wells 26 may have a width of approximately 15.0 cm and a length of approximately 33.0 cm. Additionally, the wells 26 may be spaced apart from each other a distance of approximately 25.0 cm.

A suction conduit 38 is integrated into the mat 12 and the suction conduit 38 is in communication with the plurality of suction holes 18. The suction conduit 38 is positioned between the top surface 20 and the bottom surface 22 of the mat 12. The suction conduit 38 has a first section 40 extending from a first lateral side 42 of the perimeter surface 24 of the mat 12 toward a second lateral side 44 of the perimeter surface 24 of the mat 12. Furthermore, the first section 40 is positioned between the pair of wells 26 and the back side 34 of the perimeter surface 24 of the mat 12. The conduit has a pair of second sections 46 each extending from the first section 40 beneath a respective one of the wells 26 and each of the second sections 46 intersects with the plurality of suction holes 18 in the respective well 26.

A nozzle 48 is attached to the mat 12 and the nozzle 48 can be fluidly coupled to a suction hose 50 of a vacuum source 52. The vacuum source 52 may be an electric vacuum such as a shop vacuum, for example. The nozzle 48 is in communication with the suction conduit 38 such that each of the plurality of suction holes 18 can suck the debris 54 from soles 56 of the user's shoes 58 into the vacuum source 52 when the user 16 steps on the plurality of suction holes 18. In this way the user 16 does not track the debris 54 into a house, for example, when the user 16 enters the house. The nozzle 48 is attached to the first lateral side 42 of the perimeter surface 24 of the mat 12 and the nozzle 48 is fluidly attached to the first section 40 of the suction conduit 38. The nozzle 48 has a distal end 58 with respect to the perimeter surface 24 of the mat 12 and the distal end 58 is open.

A pair of mesh screens 60 is each positioned over respective ones of the plurality of suction holes 18 such that each of the mesh screens 60 can be stepped upon. Each of the mesh screens 60 has a perimeter edge 62 and each of the mesh screens 60 has a border 64 extending around the perimeter edge 62. Each of the mesh screens 60 is positioned in a respective one of the wells 26 in the top surface 20 of the mat 12 and the border 64 of each of the mesh screens 60 conforms to the lateral bounding surface 30 of the respective mesh screen 60. Each of the mesh screens 60 may be comprised of plastic or other type of resilient material that will not be damaged by the soles 56 of the user's shoes 58.

In use, the mat 12 is placed in a strategic position such that the user 16 can step on the mat 12 once the user 16 comes indoors after being outside. The user 16 stands on each of the mesh screens 60 and the vacuum source 52 is turned on. In this way the suction holes 18 suctionally remove debris 54 from the soles 56 of the user's shoes 58. Furthermore, the user 16 can scrub the soles 56 of their shoes 58 on the mesh screens 60 to facilitate the debris 54 to be dislodged from the soles 56 of their shoes 58. In this way the user 16 does not track the debris 54 into their house, for example, after coming indoors.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A footwear vacuum assembly for collecting debris from a sole of a shoe for subsequent disposal, said assembly comprising:

a mat being positionable on a floor wherein said mat is configured to be stepped upon by a user, said mat having a plurality of suction holes being integrated into said mat, said plurality of suction holes being strategically positioned on said mat wherein said plurality of suction holes is configured to be stepped upon by the user;

a suction conduit being integrated into said mat, said suction conduit being in communication with said plurality of suction holes;

a nozzle being attached to said mat wherein said nozzle is configured to be fluidly coupled to a suction hose of a vacuum source, said nozzle being in communication with said suction conduit wherein each of said plurality of suction holes is configured to suck the debris from soles of the user's shoes into the vacuum source when the user steps on said plurality of suction holes;

a pair of mesh screens, each of said mesh screens being positioned over respective ones of said plurality of suction holes wherein each of said mesh screens is configured to be stepped upon;

wherein said mat has a top surface, a bottom surface, and a perimeter surface extending between said top surface and said bottom surface, said perimeter surface angling inwardly between said bottom surface and said top surface such that said mat has a trapezoidal shape;

wherein said mat has a pair of wells each extending downwardly in said top surface, each of said wells having a lower bounding surface and a lateral bounding surface, said lateral bounding surface of each of said wells being continuously arcuate such that each of said wells is rounded, each of said wells being elongated along an axis extending between a front side and a back side of said perimeter surface of said mat such that each of said wells has an ovoid shape;

wherein each of said plurality of suction holes extends through said lower bounding surface of a respective one of said wells, said plurality of suction holes in each of said wells being arranged into a plurality of rows in said respective well; and wherein said suction conduit is positioned between said top surface and said bottom surface of said mat, said suction conduit having a first section extending from a first lateral side of said perimeter surface of said mat toward a second lateral side of said perimeter surface of said mat, said first section being positioned between said pair of wells and said back side of said perimeter surface of said mat, said conduit having a pair of second sections each extending from said first section beneath a respective one of said wells, each of said second sections intersecting with said plurality of suction holes in said respective well.

2. The assembly according to claim 1, wherein said nozzle is attached to said first lateral side of said perimeter surface of said mat, said nozzle being fluidly attached to said first section of said suction conduit, said nozzle having a distal end with respect to said perimeter surface of said mat, said distal end being open.

3. The assembly according to claim 1, wherein each of said mesh screens has a perimeter edge, each of said mesh screens having a border extending around said perimeter edge, each of said mesh screens being positioned in a respective one of said wells in said top surface of said mat, said border of each of said mesh screens conforming to said lateral bounding surface of said respective mesh screen.

4. A footwear vacuum assembly for collecting debris from a sole of a shoe for subsequent disposal, said assembly comprising:

a mat being positionable on a floor wherein said mat is configured to be stepped upon by a user, said mat having a plurality of suction holes being integrated into said mat, said plurality of suction holes being strategically positioned on said mat wherein said plurality of suction holes is configured to be stepped upon by the user, said mat having a top surface, a bottom surface, and a perimeter surface extending between said top surface and said bottom surface, said perimeter surface angling inwardly between said bottom surface and said top surface such that said mat has a trapezoidal shape, said mat having a pair of wells each extending downwardly in said top surface, each of said wells having a lower bounding surface and a lateral bounding surface, said lateral bounding surface of each of said wells being continuously arcuate such that each of said wells is rounded, each of said wells being elongated along an axis extending between a front side and a back side of said perimeter surface of said mat such that each of said wells has an ovoid shape, each of said plurality of suction holes extending through said lower bounding surface of a respective one of said wells, said plurality of suction holes in each of said wells being arranged into a plurality of rows in said respective well;

a suction conduit being integrated into said mat, said suction conduit being in communication with said plurality of suction holes, said suction conduit being positioned between said top surface and said bottom surface of said mat, said suction conduit having a first section extending from a first lateral side of said perimeter surface of said mat toward a second lateral side of said perimeter surface of said mat, said first section being positioned between said pair of wells and said back side of said perimeter surface of said mat, said conduit having a pair of second sections each extending from said first section beneath a respective one of said wells, each of said second sections intersecting with said plurality of suction holes in said respective well;

a nozzle being attached to said mat wherein said nozzle is configured to be fluidly coupled to a suction hose of a vacuum source, said nozzle being in communication with said suction conduit wherein each of said plurality of suction holes is configured to suck the debris from soles of the user's shoes into the vacuum source when the user steps on said plurality of suction holes, said nozzle being attached to said first lateral side of said perimeter surface of said mat, said nozzle being fluidly attached to said first section of said suction conduit, said nozzle having a distal end with respect to said perimeter surface of said mat, said distal end being open; and a pair of mesh screens, each of said mesh screens being positioned over respective ones of said plurality of suction holes wherein each of said mesh screens is configured to be stepped upon, each of said mesh screens having a perimeter edge, each of said mesh screens having a border extending around said perimeter edge, each of said mesh screens being positioned in a respective one of said wells in said top surface of said mat, said border of each of said mesh screens conforming to said lateral bounding surface of said respective mesh screen.

5. A footwear vacuum system for collecting debris from a sole of a shoe for subsequent disposal, said system comprising:

a vacuum having a suction hose;

a mat being positionable on a floor wherein said mat is configured to be stepped upon by a user, said mat having a plurality of suction holes being integrated into said mat, said plurality of suction holes being strategically positioned on said mat wherein said plurality of suction holes is configured to be stepped upon by the user, said mat having a top surface, a bottom surface, and a perimeter surface extending between said top surface and said bottom surface, said perimeter surface angling inwardly between said bottom surface and said top surface such that said mat has a trapezoidal shape, said mat having a pair of wells each extending downwardly in said top surface, each of said wells having a lower bounding surface and a lateral bounding surface, said lateral bounding surface of each of said wells being continuously arcuate such that each of said wells is rounded, each of said wells being elongated along an axis extending between a front side and a back side of said perimeter surface of said mat such that each of said wells has an ovoid shape, each of said plurality of suction holes extending through said lower bounding surface of a respective one of said wells, said plurality of suction holes in each of said wells being arranged into a plurality of rows in said respective well;

a suction conduit being integrated into said mat, said suction conduit being in communication with said plurality of suction holes, said suction conduit being positioned between said top surface and said bottom surface of said mat, said suction conduit having a first section extending from a first lateral side of said perimeter surface of said mat toward a second lateral side of said perimeter surface of said mat, said first section being positioned between said pair of wells and said back side of said perimeter surface of said mat, said conduit having a pair of second sections each extending from said first section beneath a respective one of said wells, each of said second sections intersecting with said plurality of suction holes in said respective well;

a nozzle being attached to said mat, said nozzle being fluidly coupled to said suction hose of said vacuum, said nozzle being in communication with said suction conduit wherein each of said plurality of suction holes is configured to suck the debris from soles of the user's shoes into said vacuum when the user steps on said plurality of suction holes, said nozzle being attached to said first lateral side of said perimeter surface of said mat, said nozzle being fluidly attached to said first section of said suction conduit, said nozzle having a distal end with respect to said perimeter surface of said mat, said distal end being open; and a pair of mesh screens, each of said mesh screens being positioned over respective ones of said plurality of suction holes wherein each of said mesh screens is configured to be stepped upon, each of said mesh screens having a perimeter edge, each of said mesh screens having a border extending around said perimeter edge, each of said mesh screens being positioned in a respective one of said wells in said top surface of said mat, said border of each of said mesh screens conforming to said lateral bounding surface of said respective mesh screen.

* * * * *